US005680852A

United States Patent [19]

Tentler et al.

[11] Patent Number: 5,680,852

[45] Date of Patent: Oct. 28, 1997

[54] BOW STRING RELEASE WITH INTERCHANGEABLE HEADS

[75] Inventors: Lynn A. Tentler; Paul L. Peck, both of Fond du Lac, Wis.

[73] Assignee: Tru-Fire Corporation, North Fond du Lac, Wis.

[21] Appl. No.: 672,876

[22] Filed: Jun. 28, 1996

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 4,881,516 | 11/1989 | Peck | 124/35.2 |
| 5,025,772 | 6/1991 | Stevenson | 124/35.2 |
| 5,263,466 | 11/1993 | Peck | 124/35.2 |
| 5,318,004 | 6/1994 | Peck | 124/35.2 |
| 5,370,102 | 12/1994 | Peck | 124/35.2 |
| 5,417,197 | 5/1995 | Bankstahl | 124/35.2 |

*Primary Examiner*—John A. Ricci

*Attorney, Agent, or Firm*—Robert C. Curfiss; Mark A. Tidwell

[57] ABSTRACT

The subject invention provides a bow string release mechanism that can be outfitted with various types of interchangeable sear heads. The release mechanism generally comprises a sear head and a universal base, within which is mounted a trigger, a trigger arm linked to the trigger, and a spring-loaded locking yoke. The standard elements of all sear heads include a spring-loaded activation shaft and tabs which are receivable within notches provided in the base. An interchangeable sear head is attached to the base by fitting the tabs of the head into the notches of the base and rotating the head relative to the base until the yoke locks the head into place. Although selectively removable, the sear head, once locked into position on the release mechanism, is fully rotatable relative to the base. A sear head is removed from the base by releasing the yoke from engagement with the sear head and rotating the sear head relative to the base until the tabs and the notches align.

20 Claims, 3 Drawing Sheets

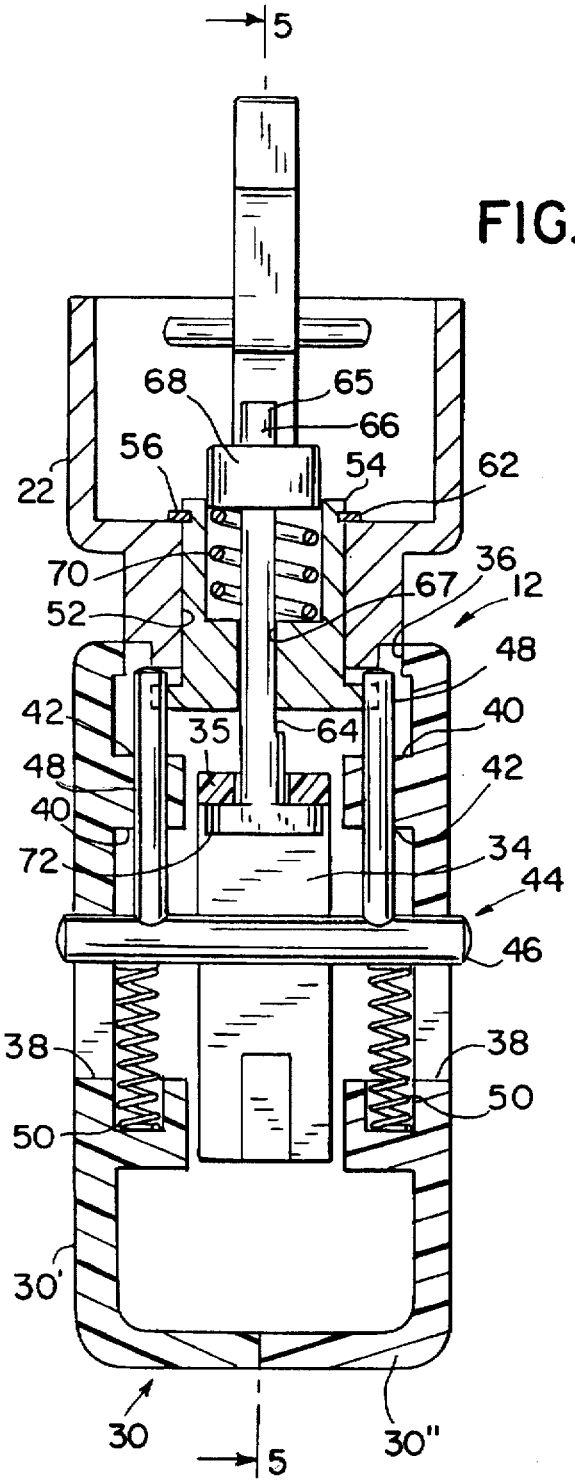
FIG. 3
FIG. 4
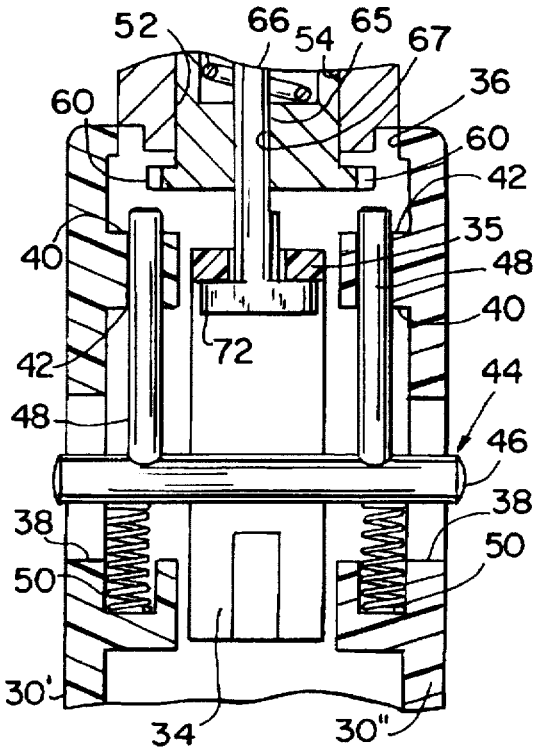

FIG. 5
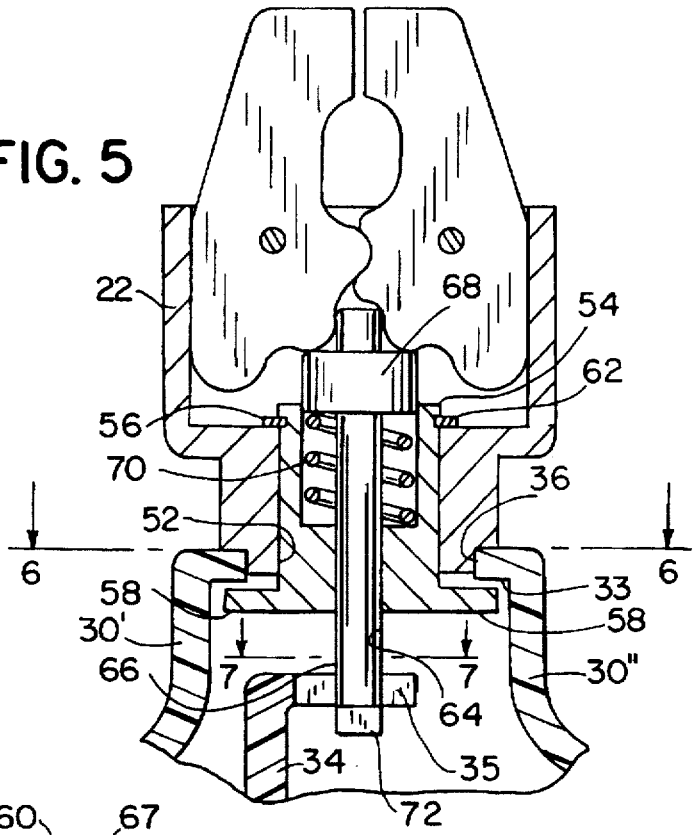
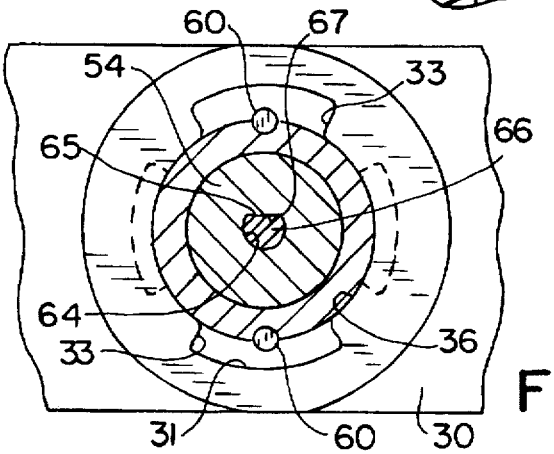
FIG. 6
FIG. 7
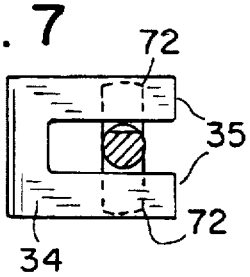
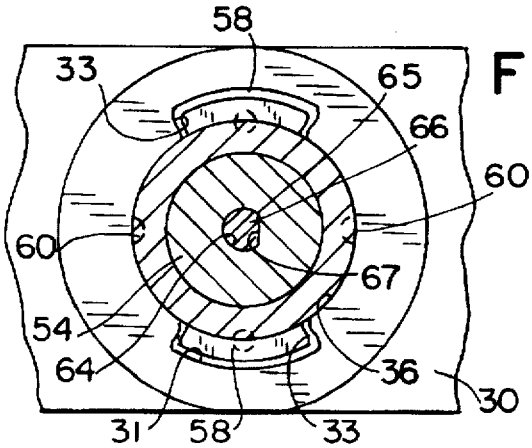
FIG. 8
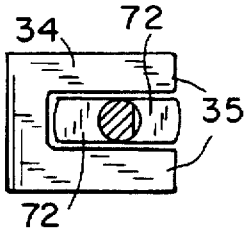
FIG.9

BOW STRING RELEASE WITH INTERCHANGEABLE HEADS

BACKGROUND OF INVENTION

1. Field of Invention

The subject invention is generally related to bow string releases and is specifically directed to a release having interchangeable release heads.

2. Description of the Prior Art

Bow string releases have grown in popularity for target shooting and for hunting. A good release provides uniform release of the bow string and thus increases accuracy. The release is either hand held or strapped to the wrist and is provided with a trigger which permits the archer to activate a string retaining and releasing mechanism. Typically, such mechanisms utilize either pivotable jaws or a pin and flexible eyed loop as the sear means for retaining a bow string. It has been found that pivotable jaw type sear means are preferred for bow hunting, while the pin and flexible eyed loop sear means are preferred for target practice. Pivotable jaw type sear means generally employ either one or two elongated, caliper type jaws which are pivotally mounted adjacent one another within the head of the release. In the string retaining position, the jaws abut one another and the bow string is held in a notch formed within the jaws. In the string releasing position, the jaws are separated from one another such that the bow string is unseated from the notch.

It is also well known to use discrete ball or cylindrical elements in place of the pivotable jaw to retain and release the bow string. The discrete elements are retained adjacent one another in opposed slots provided within the head of the release mechanism. A yoke or sleeve, under tension by a spring, is used to urge the discrete elements against one another such that they prevent release of a bow string retained in a notch provided within the head. When the yoke is retracted, the discrete elements are free to slide within their respective slots, and as such, the tension of the bow string pulls the bow string between the elements for release of the bow string from the retaining mechanism.

Pin and flexible eyed loop sear means generally comprise a retractable pin or hook mounted adjacent a piece of filament attached to a release housing. The first end of the filament is attached to the housing on one side of the pin and the second end of the filament is attached to the housing on the other side of the pin such that the filament forms a loop about the pin. In a bow string retaining position, the filament passes around a bow string and the eye formed by the loop is hooked onto the retractable pin. Upon release, the pin is retracted and the filament is released, which in turn, releases the bow string.

In any event, whether the sear mechanism is comprised of pivotable jaws, discrete elements or a flexible eyed loop, it is activated and secured by moving a trigger pivotally attached to the bow string release. Typically, the trigger is linked to a rod or shaft which extends through the body of the bow string release and attaches to the sear mechanism. Movement of the trigger will therefore result in activation of the sear mechanism.

One drawback of the bow string releases of the prior art is that they are not interchangeable for various applications and under various conditions. As explained above, archers typically prefer pivotable jaw type or discrete element type bow string release mechanisms for bow hunting, while they prefer flexible eyed loop type bow string release mechanisms for target practice. Therefore, those archers who participate in both activities generally require two or more bow string releases, one release outfitted with a hunting sear mechanism and one release outfitted with a target practice sear mechanism. The same is true for those archers who prefer to use sear mechanisms that provide different "feels". These archers may have several different types of release mechanisms, such as a pivotable jaw type release mechanism and a discrete element release mechanism, to accommodate their preferences. As such, an archer may be forced to carry several different bow string releases which can be cumbersome as well as costly.

Another disadvantage with the bow strings releases of the prior art is that damage to one portion of the release, such as the sear mechanism or the trigger mechanism, could render the entire bow string release mechanism useless, requiring either repair or replacement.

In addition, many of the releases of the prior art are not fully adjustable relative to the hand of the archer. As such, the archer must move the entire release mechanism until the sear head properly engages the bow string. In such instances, the ultimate position of the archer's hand may not be the most comfortable and natural hand position. To date, most releases permit only limited adjustment of the sear head relative to the release mechanism, but none are designed to be rotatable about a full 360°.

BRIEF SUMMARY OF THE INVENTION

The subject invention provides a bow string release mechanism that can be outfitted with various types of interchangeable sear heads. The release mechanism generally comprises a sear head and a universal base, within which is mounted a trigger, a trigger arm linked to the trigger, and a spring-loaded locking yoke. The standard elements of all sear heads include a spring-loaded activation shaft and tabs which are receivable within notches provided in the base.

A sear head is attached to the base by fitting the tabs of the head into the notches of the base and rotating the head relative to the base until the yoke locks the head into place. Although selectively removable, the sear head, once locked into position on the release mechanism, is fully rotatable relative to the base. A sear head is removed from the base by releasing the yoke from engagement with the sear head and rotating the sear head relative to the base until the tabs and the notches align.

When the sear head is locked into place on the base, the trigger arm of the base engages the activation shaft of the sear head such that the specific string retaining mechanism of the sear head can be activated through manipulation of the trigger. For example, if the string retaining mechanism comprises pivotally mounted jaws, the activation shaft is used to urge the jaws between an open and closed position. If the string retaining mechanism is of the discrete element type, the activation shaft is used to urge the yoke against the discrete elements. Finally, if the string retaining mechanism is of the flexible, eyed loop type, the activation shaft is used to engage and release the filament retaining pin.

BRIEF DESCRIPTION OF THE DRAWINGS

FIG. 3 is a cut-away side view of the universal base having an attached sear head in which the sear head is locked into position by the yoke.

FIG. 4 is a cut-away side view of the universal base having an attached sear head in which the yoke of the base is withdrawn from locking engagement with the sear head.

FIG. 5 is a sectional side view of FIG. 3.

FIG. 6 is a front sectional view of the base in which a sear head is locked into engagement with the base.

FIG. 7 is a front section view of the base illustrating engagement of the trigger arm of the base by the activation shaft of a sear head.

FIG. 8 is a front sectional view of the base illustrating alignment of the sear head tabs with the notches of the base.

FIG. 9 is a front sectional view of the base illustrating alignment of the trigger arm and activation shaft during removal and attachment of a sear head to the base.

DETAILED DESCRIPTION OF THE PREFERRED EMBODIMENTS

Figure 1:
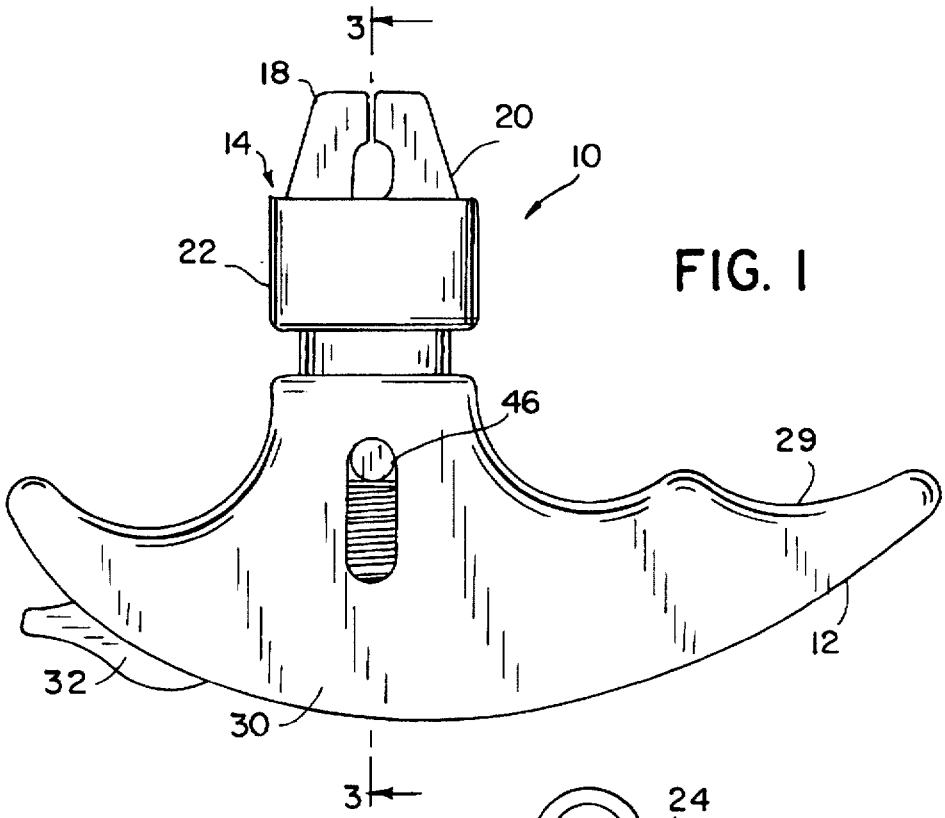
FIG. 1 is an elevational side view of the bow string release of the present invention with a caliper type sear head attached to the universal base.
Figure 2:
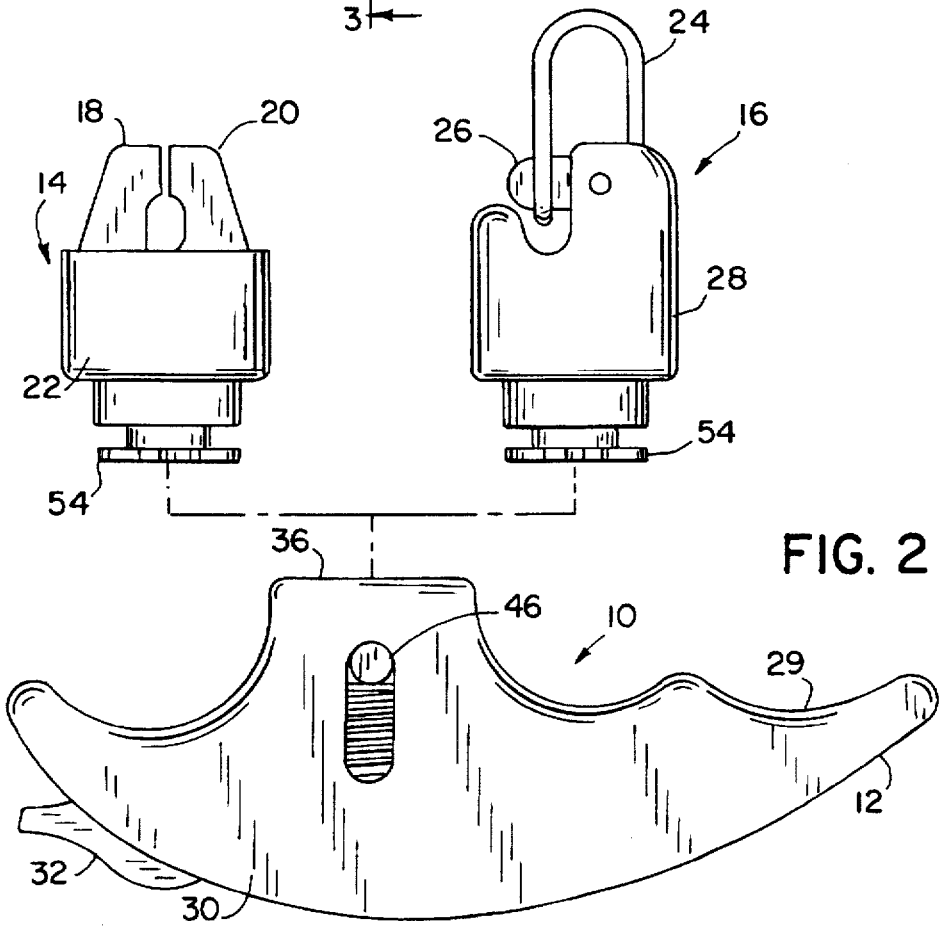
FIG. 2 is an elevational side view of the universal base along with an unattached caliper type sear head and an unattached flexible, eyed loop type sear head.

A bow string release of the present invention is shown in FIGS. 1 and 2 and generally designated as 10. Bow string release 10 is generally comprised of a universal base 12 to which one of a plurality of sear heads can be selectively attached. Although the sear heads may take many forms, FIG. 2 illustrates a caliper type sear head 14 and a flexible loop type sear head 16. FIG. 1 specifically illustrates base 12 fitted with a caliper type sear head 14. As shown in FIG. 2, caliper type sear head 14 includes a pair of jaws 18, 20 which are pivotally mounted within a cylindrical housing 22. Flexible loop type sear head 16 includes a flexible filament 24 and a pin 26 pivotally mounted within a cylindrical housing 28. In the preferred embodiment, the plurality of sear heads are configured to be selectively attachable to a universal base 12, such that an archer may interchange sear heads as desired.

With specific reference to FIG. 3, base 12 includes a housing 30 with a first half 30' and a second half 30". In one preferred embodiment, housing 30 defines a contoured gripping handle 29. Housing 30 also defines an aperture 36 for receipt of a sear head. Arcuate notches 31 (see FIGS. 6 and 8) are positioned on the perimeter of aperture 36 such that a lip 33 around the perimeter is also defined. A trigger 32 (FIGS. 1 and 2) extends from housing 30 and is linked to a trigger arm 34 which is slidably mounted within housing 30. Trigger arm 34, which is substantially aligned with aperture 36, includes fingers 35 extending therefrom (see FIGS. 7 and 9). Slots 38 and guides 40 are provided in opposing sides of housing 30. Each guide 40 defines a throughbore 42 which extends substantially colinearly with aperture 36. Also mounted within housing 30 is a locking yoke 44 having a transverse member 46 which extends across base 12 and through slots 38. Locking yoke 44 includes perpendicularly extending pins 48 which slide within throughbores 42 of guides 40. Springs 50 are mounted within base 12 and urge locking yoke 44 toward aperture 36.

Although each sear head is provided with a different string retaining mechanism, such as jaws 18, 20 or pin 26 and filament 24, all sear heads are provided with a number of common elements that permit the sear heads to be engaged by universal base 12. Each sear head housing 22, 28 is provided with a throughbore 52 in which a cylindrical fitting 54 is rotatingly mounted. On one end, cylindrical fitting 54 has an annular groove 56 around its periphery. On the other end, cylindrical fitting 54 is provided with opposing annular tabs 58 and opposing channel notches 60 on its periphery. When seated in throughbore 52, fitting 54 is secured in place by retaining ring 62 which seats in annular groove 56 and abuts the inner surface of the sear head housing. Axially extending through fitting 54 is throughbore 64 in which is slidingly mounted activation shaft 66. In one embodiment, throughbore 64 is provided with at least one flat surface 65 which abuts a corresponding flat surface 67 of activation shaft 66, such that activation shaft 66 can slide within throughbore 64 without rotating. Threadingly engaged on activation shaft 66 is collar 68 which retains spring 70 on shaft 66. On the opposite end, shaft 66 is provided with extensions 72.

Turning now to the manner in which bow string release 10 operates, the desired sear head is selected and tabs 58 of the sear head are aligned with arcuate notches 31 of universal base 12 such that fitting 54 of the sear head and aperture 36 of base 12 are coaxial. The sear head is engaged by the universal base by passing tabs 58 through arcuate notches 31 and rotating fitting 54 relative to base 12 until pins 48 of locking yoke 44 are aligned with channel notches 60 of fitting 54 such that springs 50 urge pins 48 to seat within notches 60. In this position, tabs 58 abut lip 33 and prevent the sear head from disengaging from the universal base. When the sear head is aligned for engagement with the universal base as described above, activation shaft 66 is aligned with trigger arm 34 so that insertion of the sear head into aperture 36 causes extensions 72 of activation shaft 66 to pass between fingers 35 of trigger arm 34. Subsequent rotation of fitting 54 relative to base 12 causes extensions 72 to be engaged by fingers 35, thus forming a link between trigger arm 34 and activation shaft 66 such that manipulation of trigger 32 activates the respective string retaining mechanism of the sear head. Spring 70 urges activation shaft 66 into fitting 54 such that extensions 72 of activation shaft 72 are urged against fingers 35 of trigger arm 34 the sear head is engaged by base 12.

Although fitting 54 and activation shaft 66 are now fixed relative to base 12, housing 22, 28 is free to rotate on fitting 54. As such, the string retaining mechanism, such as jaws 18, 20 or pin 26 and filament 24, which is attached to housing 22, 28, respectively, can be rotated about a full 360° without the need to rotate base 12.

To remove a sear head from engagement with universal base 12, transverse member 46, which projects through slots 38, is slid back against the force of springs 50 such that pins 48 are withdrawn from notches 60. Cylindrical plug 54 can then be rotated until tabs 58 align with arcuate notches 31, permitting withdrawal of fitting 54 from aperture 36.

While certain features and embodiments of the invention have been described in detail herein, it will be readily understood that the invention encompasses all modifications and enhancements within the scope and spirit of the following claims.

What is claimed is:

1. A bow string release comprising:

a. a fully assembled, operational head for selectively engaging and releasing a bow string, said head having a head activation means disposed therein; and b. a universal base having a fully assembled, operational trigger mechanism and a head engagement mechanism for engaging said head, c. wherein said head is selectively detachable from engagement with said universal base and the head and the base each remain fully operational when the head is detached from the base.

2. The bow string release of claim 1 wherein said trigger mechanism includes a trigger pivotally attached to a trigger arm, wherein said trigger arm engages said head activation means.

3. The bow string release of claim 1 wherein said head includes an engagement tab and said head engagement mechanism includes a housing having an aperture and a when said engagement tab is aligned with said slot.

4. The bow string release of claim 1 wherein said head includes a locking notch and said head engagement mechanism includes a locking yoke disposed within a base housing, wherein said locking yoke of said base housing seats within said locking notch of said head when said head is engaged by said base.

5. The bow string release of claim 1 wherein said head includes an engagement tab and a locking notch and said head engagement mechanism includes a locking yoke disposed within a base housing, said base housing having an aperture and a slot defined therein, wherein said aperture is disposed for receipt and release of said head when said engagement tab is aligned with said slot and wherein said locking yoke of said base housing seats within said locking notch of said head when said head is engaged by said base.

6. The bow string release of claim 1, wherein said head includes a string retaining mechanism activatable by said head activation means.

7. The bow string release of claim 6, wherein said string retaining mechanism is rotatable with respect to said universal base when said head mechanism is engaged by said base.

8. A bow string release comprising:

a. a universal base comprising:
(1) a base housing defining an engagement aperture;
(2) a trigger mechanism attached to said base housing;
(3) a locking mechanism disposed within said base housing; and b. a head comprising:
(1) a head housing;
(2) a fitting mounted within said head housing, said fitting having an engagement tab and a locking notch;
(3) an activation means movably disposed in said fitting and extending therefrom; and
(4) a bow string retaining mechanism mounted within said head housing and engaged by said activation means;

c. wherein said head is engaged by said universal base by inserting said fitting into said engagement aperture and rotating said fitting until said locking mechanism seats in said locking notch and said activation means is engaged by said trigger.

9. The bow string release of claim 8 wherein said base housing is handle shaped.

10. The bow string release of claim 8 wherein said trigger is a butterfly trigger.

11. The bow string release of claim 8 wherein said locking mechanism is retractable.

12. The bow string release of claim 8 wherein said locking mechanism is a yoke urged toward said engagement aperture by a spring mounted within said base.

13. The bow string release of claim 8 wherein said activation means includes an engagement finger and said trigger mechanism includes a trigger arm having an engagement finger, wherein said engagement finger of said activation means engages said engagement finger of said trigger arm when said head is engaged by said base.

14. The bow string release of claim 13 wherein said activation means includes an activation shaft and a spring for urging said activation shaft into said fitting such that said fingers of said activation means are urged against said fingers of said trigger arm when said head is engaged by said base.

15. A bow string release mechanism having interchangeable heads, said bow string release mechanism comprising:

a universal base comprising:
(1) a base housing defining an engagement aperture, an arcuate notch disposed on the periphery of said aperture, and opposing slots;
(2) a trigger pivotally mounted within said base housing and extending therefrom;
(3) a trigger arm pivotally attached to said trigger and extending toward said engagement aperture;
(4) a locking yoke having a transverse member disposed within said base housing and extending through said opposing slots, at least one pin attached to said transverse member and extending toward said engagement aperture, and at least one spring urging said pin toward said aperture; and b. a head comprising:
(1) a head housing;
(2) a bow string retaining mechanism disposed within said head housing;
(3) a cylindrical fitting rotatingly disposed within said head housing, said fitting having an annular groove disposed about the periphery at a first end of the fitting a radially extending tab disposed at the second end of said fitting, a notch defined in the periphery of said fitting at said second end, and a bore extending through said fitting wherein the first end of said fitting extends into the interior of said head housing;
(4) an activation shaft slidingly disposed within said bore and extending from the second end of said fitting;
(5) a retaining ring disposed in said annular groove to secure said fitting in said head housing, c. wherein said head is mounted within said aperture of said base such that said radially extending tab of said head abuts said base housing and said pin of said locking yoke is seated within said notch of said fitting such that said fitting is fixed relative to said base and said housing is rotatable about said fixed fitting, d. wherein said activation shaft is engaged by said trigger arm, and e. wherein said head can be removed from said universal base by disengaging said pin of said locking yoke from said notch of said fitting and rotating said fitting relative to said base housing until said radially extending tab aligns with said arcuate notch, permitting withdrawal of said head from said aperture of said universal base.

16. The bow string release mechanism of claim 15, wherein said activation shaft has at least one flat surface and said bore of said cylindrical fitting has at least one flat surface corresponding to the flat surface of the activation shaft such that said shaft can slide within said bore without rotating.

17. The bow string release mechanism of claim 15, wherein said base housing is formed in the shape of a handle.

18. The bow string release mechanism of claim 15, wherein said string retaining mechanism comprises a pair of opposed jaws pivotally mounted within said head housing for movement into and out of abutting engagement with one another, each jaw having opposite outer ends, a forward end of the jaws including a string retaining notch which is closed for holding a string when the jaws are in abutting engagement and which is opened for releasing the string when the jaws are separated.

19. The bow string release mechanism of claim 15, wherein said string retaining mechanism comprises a pin pivotally mounted within said head housing and a flexible filament having a first end and a second end, wherein said filament is attached to said housing about said pin such that said filament forms a loop which can be engaged by said pin.

20. A method for using a bow string release having a universal base and a plurality of interchangeable heads, said method comprising the steps of:

a. selecting a head;

b. aligning a tab of the head with a notch in the base;

c. inserting said head into said base until said tab passes through said notch;

d. rotating said head relative to said base until said head is engaged by a locking mechanism disposed in said base; and e. activating a string retaining mechanism disposed in said head by manipulating a trigger disposed within said base.

* * * * *